United States Patent [19]

Schmitz

[11] 4,142,326

[45] Mar. 6, 1979

[54] MASS TRANSIT VEHICLE DOOR CONTROL APPARATUS

[75] Inventor: William E. Schmitz, Wilkinsburg, Pa.

[73] Assignee: Westinghouse Electric Corp., Pittsburgh, Pa.

[21] Appl. No.: 778,527

[22] Filed: Mar. 17, 1977

[51] Int. Cl.[2] ..... E05C 7/06

[52] U.S. Cl. ..... 49/118; 49/123; 49/280; 49/449

[58] Field of Search ..... 49/118, 123, 280, 360, 49/199, 139, 120, 121, 449

[56] References Cited

U.S. PATENT DOCUMENTS

| | | | |
|---|---|---|---|
| 783,582 | 2/1905 | Hodgens | 49/123 |
| 1,001,988 | 8/1911 | Rowntree | 49/280 X |
| 2,452,501 | 10/1948 | Swanson et al. | 49/280 X |
| 3,526,994 | 9/1970 | Delaney | 49/199 |
| 3,745,705 | 7/1973 | Reddy | 49/139 |

*Primary Examiner*—Kenneth Downey
*Attorney, Agent, or Firm*—R. G. Brodahl

[57] ABSTRACT

There is disclosed a motion control and locking apparatus for the passenger entry and exit doors of a mass transit vehicle, which passenger entry and exit doors are desired to be locked when the vehicle is moving between stations and are desired to be unlocked only when the vehicle has stopped at the desired location for passenger entry and exit within a station.

8 Claims, 10 Drawing Figures

MASS TRANSIT VEHICLE DOOR CONTROL APPARATUS

BACKGROUND OF THE INVENTION

It is known to operate a mass transit vehicle in conjunction with an automatic vehicle control system for providing speed and position control signals and to operate the passenger doors of such a vehicle with suitable door command signals. It is necessary to sense when the vehicle has stopped at a station platform before the door open signal causes the doors to open for the exit and entry of passengers. In addition, as described in a published article entitled "Automatic Train Control Concepts Are Implemented By Modern Equipment" by R. C. Hoyler at pages 145 through 151 of the Westinghouse Engineer for September, 1972, the vehicle door controls can be interlocked with vehicle zero speed detection to prevent automatic door opening before the vehicle has come to a stop.

A prime requirement of transit expressway and rapid transit vehicle door operation is that each door should be mechanically locked in a closed position before the vehicle is allowed to move along the track. Present mass transit vehicle door control systems employ either a lock subsystem consisting of a locking bar, unlocking force source and interlocks to maintain the locked state which is mechanically independent of the prime door opening force, or a rotary motion apparatus to close the door and the traveling overcenter of a toggle mechanism to lock the door.

SUMMARY OF THE INVENTION

The present invention provides a transit vehicle door motion and control lock apparatus responsive to a linear force over the distance of the intended door travel, with the same door open force that moves the door also functioning to unlock the door. The lock mechanism includes a drive member that initially responds to the door open force to pivot about a support pin fastened to one of the doors and operates the latch member to unlock the doors and then the drive member operates to move the one door in response to the door open force. The other door is coupled to the one door to move in conjunction with that one door.

DESCRIPTION OF THE PREFERRED EMBODIMENT

Figure 1:
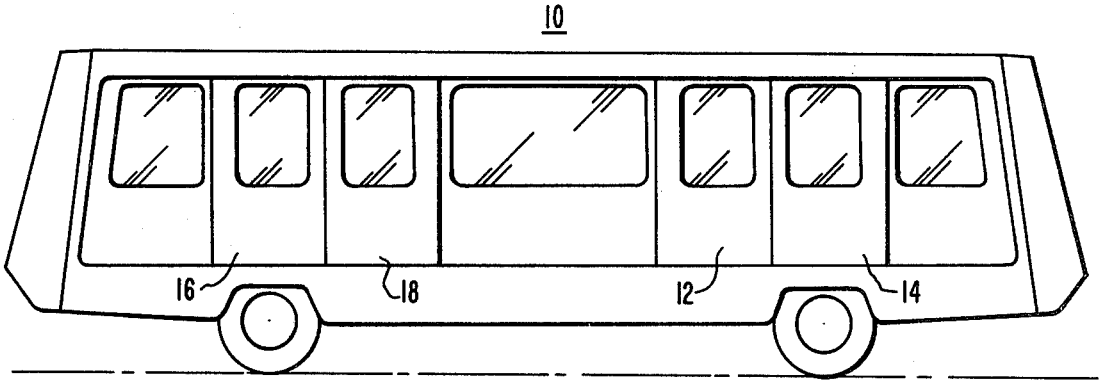
FIG. 1 is a side view of a mass transit vehicle to show the passenger doors in a closed and locked position.

In FIG. 1, there is shown a mass transit vehicle 10 including a first pair of passenger doors 12 and 14 in locked position and a second pair of passenger doors 16 and 18 in locked position.

Figures 2, 5:
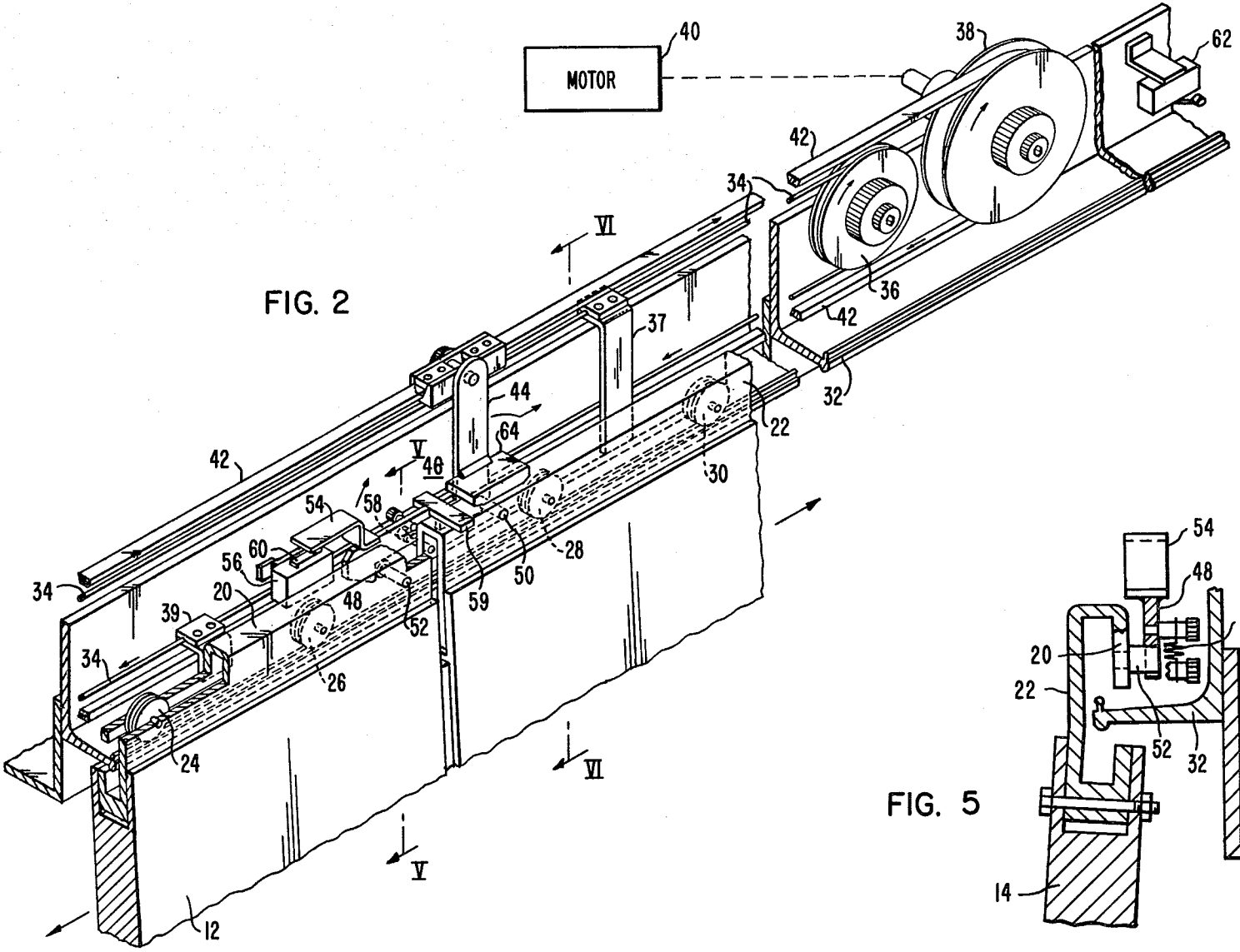
FIG. 2 is a perspective view to show a pair of biparting passenger doors, the door carriers, and lock apparatus supported by rollers running on an extruded track, with a continuous drive belt applying the door open force to that lock apparatus.
FIG. 5 is a cross sectional view showing the track member, a door carrier and the top of a passenger door.

In FIG. 2, there is shown the respective carriers 20 and 22 for the first pair of biparting passenger doors 12 and 14. The carrier 20 is supported by rollers 24 and 26 and the carrier 22 is supported by rollers 28 and 30, which rollers operate on an extruded track member 32. The bottom of each passenger door 12 and 14 is guided in a suitable retaining slot member (not shown) and which constrains the bottom of the door to move parallel to the top. A drive cable 34, which can be a metal wire cable coated with nylon, is looped around an idler pulley 36 and a similar idler pulley not shown at the left of FIG. 2, and connected through fastener 37 to move the passenger door 14 and is connected to passenger door 12 through the fastener 39 to move the passenger door 12 and to open the passenger doors 12 and 14 or to close the passenger doors 12 and 14 together. A drive pulley 38 is operative with a drive motor 40 and a drive belt member 42, which can be a well known vee belt, connected through the drive arm 44 for applying a door movement and door unlatching force to the passenger door 14. The drive member 42 provides a linear translation force to move the door 14 through its desired travel to the right as shown in FIG. 2 for the purpose of separating or opening the passenger doors 12 and 14. The same force that moves the door 14 open and closed also unlocks and locks the lock mechanism 46. When the motor 40 is not energized and the passenger doors 12 and 14 are closed, those doors 12 and 14 cannot be opened by applying an opening force directly to either door 12 or 14 or both. However, when the door opening force is applied by the drive member 42 to the lock mechanism 46 the latter will unlock and the door 14 will move to the right as shown in FIG. 2.

Figure 3A:
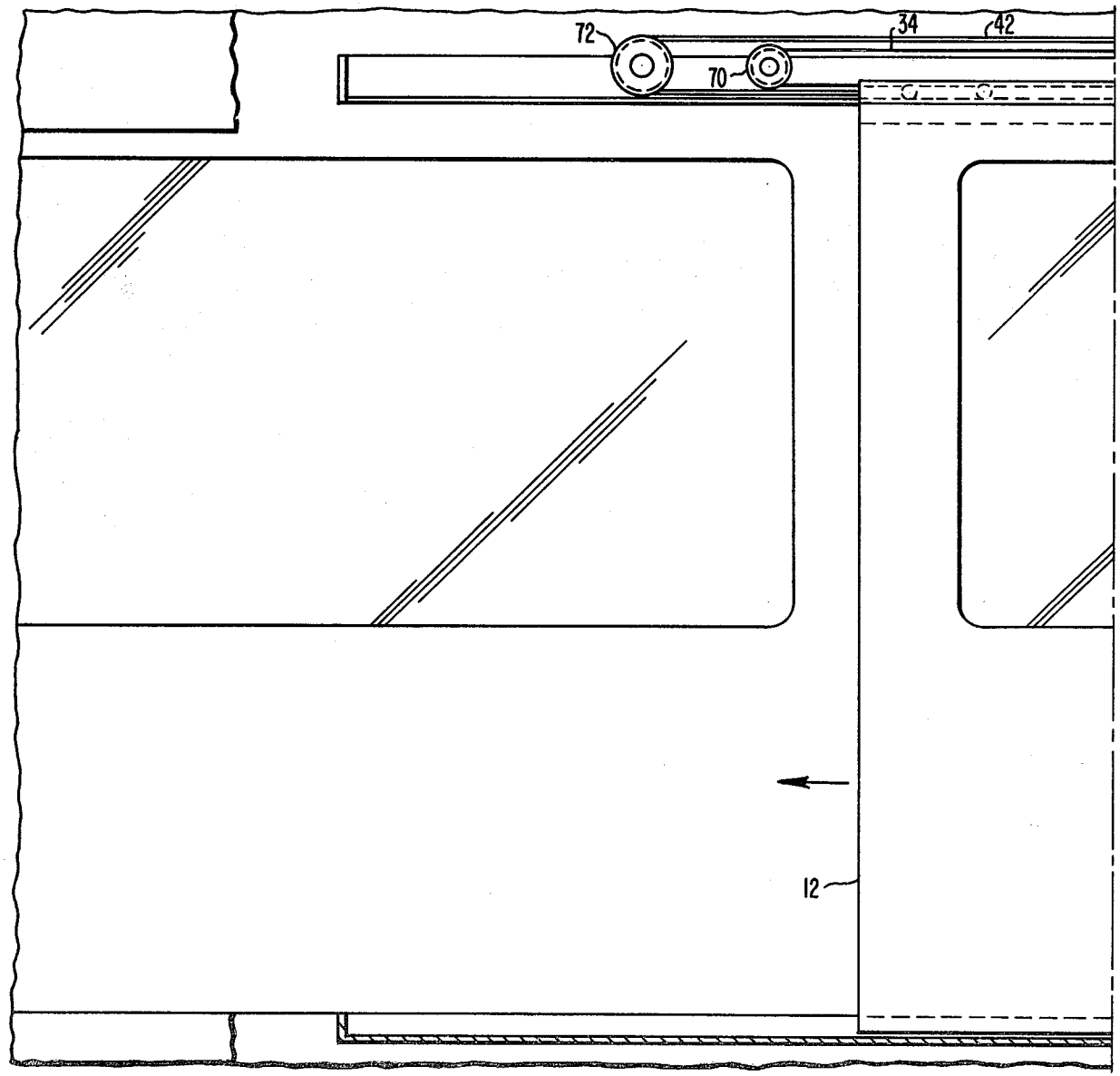
FIGS. 3A and 3B together show the biparting passenger doors operative with a mass transit vehicle.
Figure 3B:
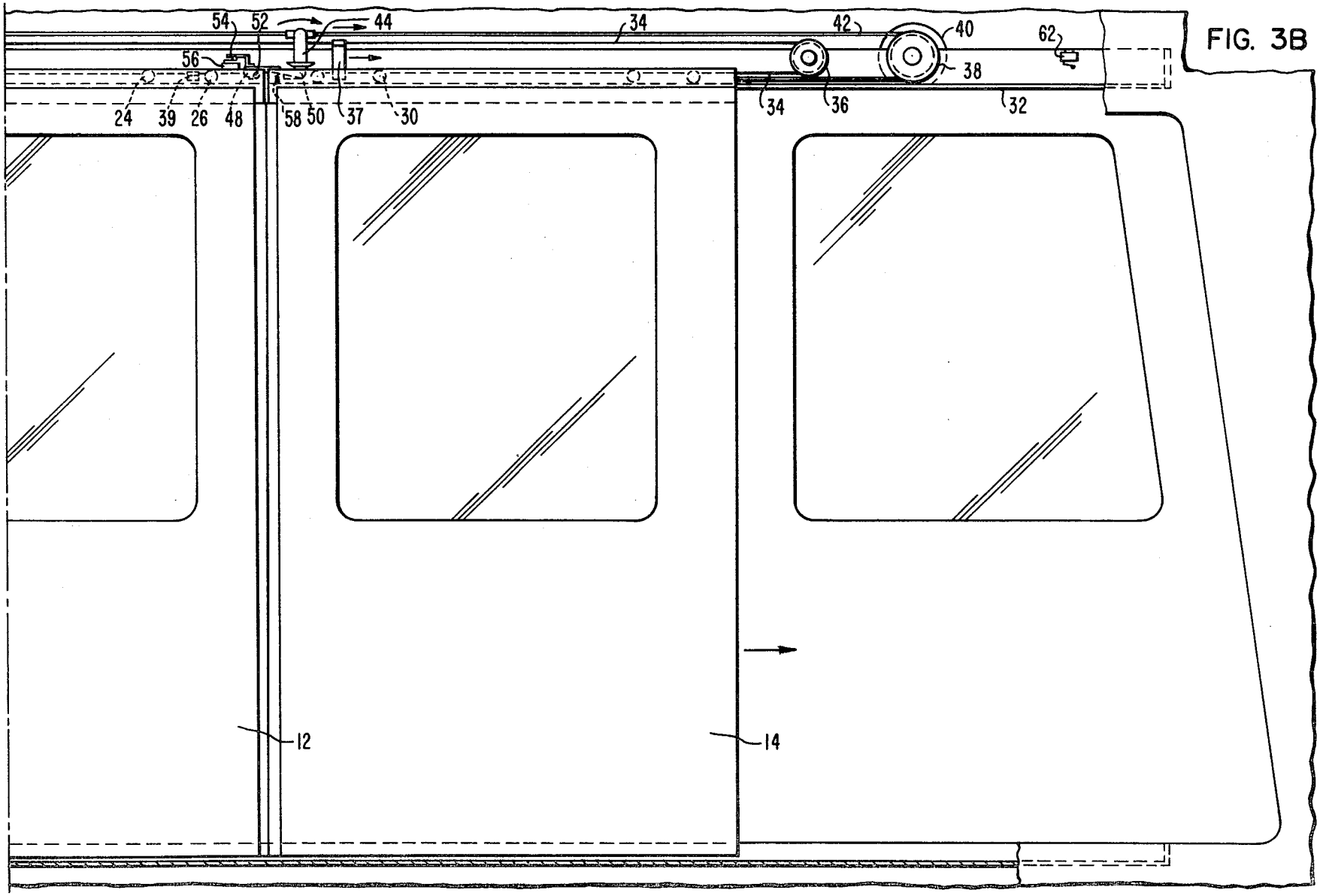

In FIGS. 3A and 3B taken together, there are shown the passenger doors 12 and 14, with the drive arm 44 rotating about the support pin 50 and connected to the drive belt member 42. The latch hook 48 operates with the latch pin 52 and is rotated about the support pin 50 by the drive arm 44. The idler pulley 70 shown in FIG. 3A is shown operative with the connecting cable 34. The idler pulley 72 is shown in FIG. 3A operative with the drive belt member 42.

Figure 4:
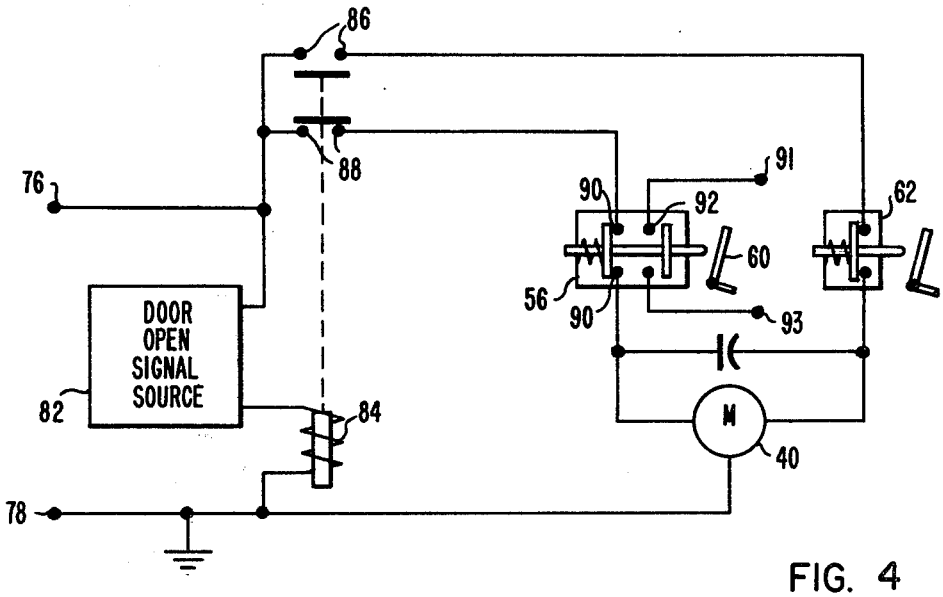
FIG. 4 shows the door motion control circuit provided to open and close the pair of passenger doors shown in FIG. 2.

In FIG. 4, there is shown the door motion and locking control circuit provided to open and close the passenger doors 12 and 14. The terminals 76 and 78 are connected to a suitable power supply, such as a source of 115 volts alternating current power. A door open command signal source 82, such as described in the above referenced published article, provides the door open command signal to energize the relay winding 84. The relay winding 84, when energized, closes the normally open contacts 86 and opens the normally closed contacts 88. When the contacts 86 close, the drive motor 40 is energized through the normally closed limit switch 62, which limit switch 62 opens when the passenger door 14 opens and the door carrier 22 shown in FIG. 2 connects with the limit switch 62 for the purpose of opening the limit switch 62 to stop the operation of the drive motor 40. When the door open command signal from the source 82 is removed, the relay winding 84 is de-energized, and the contacts 88 open and the contacts 86 close. The motor 40 is energized in a reverse direction through the now-closed contacts 88 and the contacts 90 of the limit switch 56, which contacts are normally closed and are opened when the door 14 assumes the closed and locked position. When the door 14 becomes closed, the extension arm 54 of the latch hook 48 moves the member 60 to open the contacts 90 to deenergize the drive motor 40. When the member 60 operates the limit switch 56, the contacts 92 are closed to provide the required door closed indication signal through terminals 91 and 93.

In FIG. 5 there is provided a cross sectional view taken in the plane V—V of FIG. 2 and showing the relationship between the track member 32, the door carrier 20, the support pin 52, the latch hook 48, the drive arm 44 and the extension 54.

Figure 6:
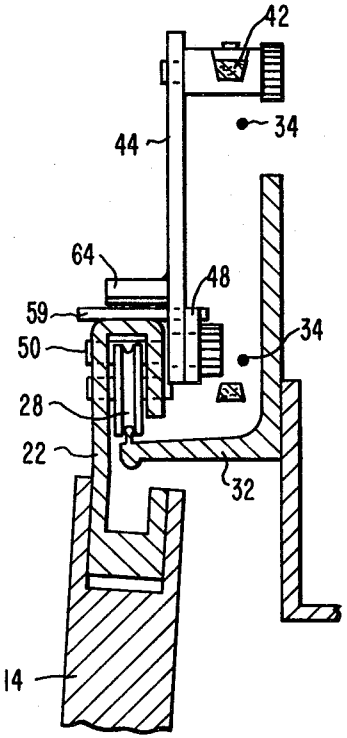
FIG. 6 is a cross sectional view showing the track member, a door carrier, the drive member and the latch hook.

In FIG. 6 there is provided a cross sectional view taken in the plane VI—VI of FIG. 2 and showing the relationship between the track member 32, the door carrier 22, the door 14, the roller 28, the drive member 44, the latch hook 48, the support pin 50, the member 64 and the latch hook stop 59.

Figure 7:
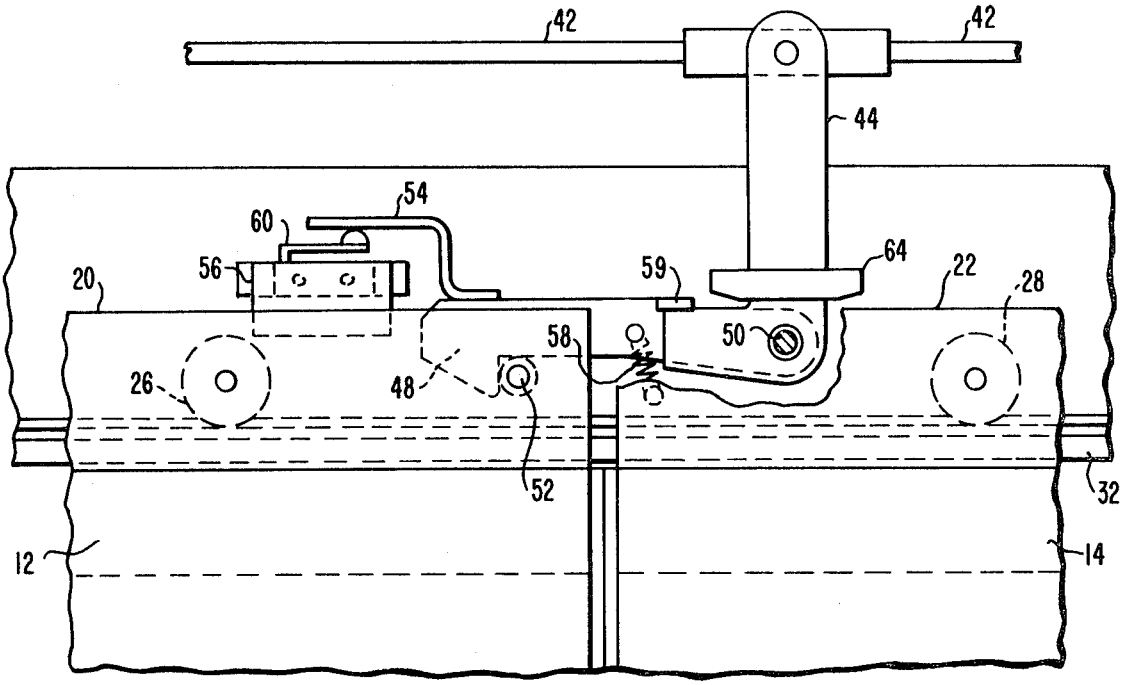
FIG. 7 is a side view showing the drive member and the latch hook in a door locked position.

In FIG. 7 the lock mechanism 46 is shown in more detail and includes the drive arm member 44 mounted to door carrier 22 by support pivot 50, the latch hook member 48 mounted to door carrier 22 by support pivot 50, and a latch pin 52 which is mounted to door carrier 20. The drive arm member 44 rotates about support pivot 50 and is limited in both clockwise and counterclockwise directions by drive arm stop 64 contacting the top of the door carrier 22. The latch hook member 48 rotates about support pivot 50 and is limited in the counterclockwise direction by a latch hook stop 59 contacting the top of the door carrier 22. The latch hook member 48 is force biased by gravity and a spring 58 to rotate counterclockwise. A portion of the drive arm member 44 extends under latch hook stop 59 such that when the drive arm member 44 is rotated clockwise, the latch hook member 48 is also rotated clockwise. With the door 14 in the closed and locked position, the sequence of a door open and close cycle is as follows. Upon receiving a door open signal, the motor 40 shown in FIG. 2 rotates the driver pulley 38 which applies a linear force to drive belt member 42 connected to drive arm member 44. The drive arm member 44 initially rotates about support pin 50, lifting the latch hook 48 against gravity and the spring 58 until the latch pin 52 is cleared by the latch hook 48. The drive arm 44 and latch hook 48 continue to rotate about support pin 50 until the drive arm stop 64 contacts the top of door carrier 22 at which time the door carrier 22 and door panel 14 are pulled to the right. Door carrier 20 and door panel 12 are simultaneously pulled to the left by action of the connecting cable 34. The doors 12 and 14 continue to open until the carrier 22 strikes the limit switch 62, which electrically turns off the motor 40 causing the door panels to stop in their open position. When the door open signal is removed, the motor 40 reverses direction to reverse the rotation of the driver pulley 38 and apply a linear force to drive belt member 42 connected to move the top of drive arm member 44 to the left. The drive arm member 44 rotates counterclockwise until the drive arm stop 64 contacts the top of the door carrier 22 at which time the door carrier 22 and panel 14 are pulled into the closed position with the door carrier 20 and door 12, with the door 12 being pulled closed by action of the connecting cable 34. As the door carriers 20 and 22 close, the latch hook 48 on carrier 22 approaches the latch pin 52 on carrier 20, and when the carriers 22 and 20 near final closure the tapered leading edge of latch hook 48 rides up and over the latch pin 52. Gravity and the pull of spring 58 pull the latch hook 48 down over the pin 52 to lock the carrier 20 to the carrier 22. The limit switch 56 senses when the latch hook 48 has properly locked the doors 12 and 14, since the extension arm 54 opens the limit switch to shut off the drive motor 40. The shaped of the extension arm 54 and the placement of the limit switch 56 are such that latch hook 48 must ride up and over the latch pin 52 in order for the limit switch 56 to be actuated. If the latch pin 52 was not in its proper location, for example due to a broken connecting cable 34, the extension arm 54 would not ride up and the limit switch 56 would not be actuated.

Figure 8:
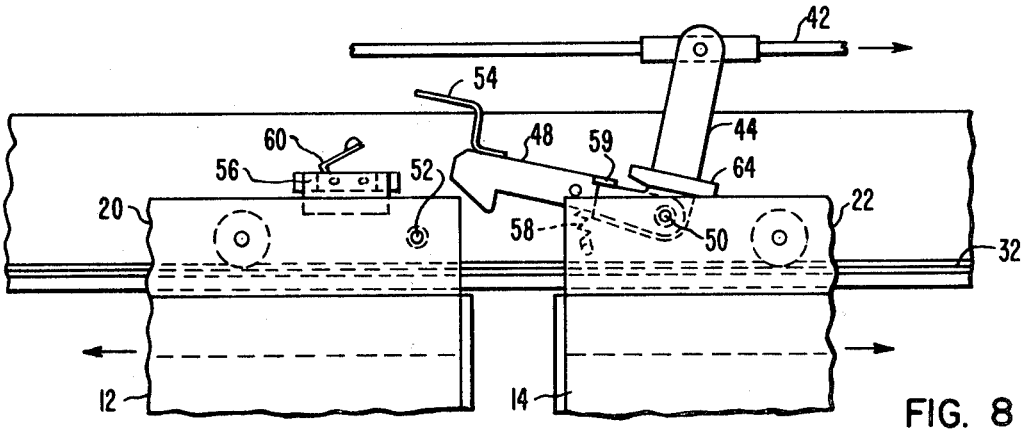
FIG. 8 shows the drive member being pulled by the drive belt in a direction to open the passenger doors.

In FIG. 8 the drive member 44 is shown rotated clockwise by the pull of the drive belt 42 to the right in a direction to open the passenger doors 12 and 14.

Figure 9:
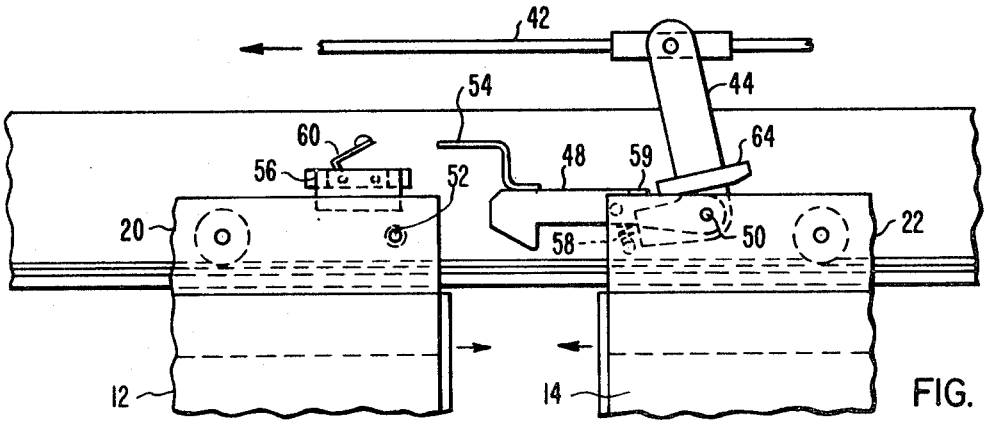
FIG. 9 shows the drive member being pulled by the drive belt in a direction to close the passenger doors.

In FIG. 9 the drive member 44 is shown rotated counterclockwise by the pull of the drive belt 42 to the left in a direction to close the passenger doors. The latch hook 48 is in position to ride up and over the latch pin 52 for locking the doors together in a closed position.

What is claimed is:

1. In door control apparatus operative with a drive motor providing a movement force to move a pair of passenger doors, first means including switch means coupled with said motor and connected to one of said doors for holding said pair of doors in a closed position, second means pivotally connected to the other of said doors and engaging said first means when the pair of doors is in a closed position, and third means pivotally connected to said other door and coupled with the second means, with said third means being responsive to said force for moving the pair of doors and for pivoting the second means to operate the switch means when said force is provided to move the pair of doors.

2. The door control apparatus of claim 1 with the first means including a latch pin connected to said one door and with the second means including a latch hook connected to said other door and engaging the latch pin when said pair of doors is in a closed position.

3. The door control apparatus of claim 1, with said switch means controlling the energization of the drive motor and being operative with the second means in the closed position of said pair of doors to deenergize the drive motor after said pair of doors arrives at the closed position.

4. In door control apparatus for a pair of passenger doors operative with a drive motor providing a movement force to open and close said doors, first means including switch means operative to control said motor and connected to one of the doors, second means including a latch hook pivotally connected to the other of the doors and coupling with the switch means when the passenger doors are closed, and third means pivotally connected to said other door and responsive to said force for moving at least said other door and uncoupling the second means in relation to the first means when it is desired to open said passenger doors, with the first means including a latch pin connected to said one door and with said latch hook coupling with the latch pin to lock the passenger doors in the closed position.

5. The door control apparatus of claim 4, including fourth means coupled between the passenger doors for moving the one door in a direction opposite to the movement of the other door in response to said force.

6. In mass transit vehicle passenger door control apparatus operative with a pair of biparting passenger doors and a motor providing a door movement force, a first member including a switch operative with said motor and coupled to one of said doors, a second member including a latch pivotally coupled to the other of said doors and operative with said switch for controlling said motor and operative with said first member for locking the pair of doors in a closed position, and drive means coupled to the second member and responsive to said door movement force to initially pivot the latch of said second member for unlocking the pair of doors and then to move said other door for opening the pair of doors, with said drive means including a drive arm pivotally coupled to said other door and operative to initially pivot in position with the latch of the second member.

7. The door control apparatus of claim 6, including means connected between said drive means and the motor for applying a selected one of a door open force to the drive means for unlocking the pair of doors and moving the pair of doors to an open position and a door closed force to the drive means for moving the pair of doors to a closed position and locking the pair of doors.

8. The door control apparatus of claim 6, with said first member including a latch pin and with said latch being biased by a spring member to securely hold the latch pin when the pair of doors is in a closed position.

* * * * *